US006259800B1

(12) United States Patent
Tagami

(10) Patent No.: US 6,259,800 B1
(45) Date of Patent: Jul. 10, 2001

(54) SPEAKER AND SPEAKER APPARATUS

(75) Inventor: Takahisa Tagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/262,920

(22) Filed: Mar. 5, 1999

(30) Foreign Application Priority Data

Mar. 11, 1998 (JP) ..... 10-060094

(51) Int. Cl.[7] ..... H04R 25/00

(52) U.S. Cl. ..... 381/412; 381/398; 381/414; 381/421; 381/431

(58) Field of Search ..... 381/152, 386, 381/392, 396, 398, 403, 412, 421, 422, 423, 430, 431, FOR 153, FOR 159, 414; 181/171, 172

(56) References Cited

U.S. PATENT DOCUMENTS 2,490,466 * 12/1949 Olson et al. ..... 181/172
5,682,436 * 10/1997 Sakamoto ..... 381/412
5,883,967 * 3/1999 House ..... 381/398

* cited by examiner

*Primary Examiner*—Huyen Le
(74) *Attorney, Agent, or Firm*—Jay H. Maioli

(57) ABSTRACT

A speaker and a speaker apparatus used for acoustic sound reproduction include a magnetic circuit unit having a center plate of a magnetic material and a set of magnets arranged on both sides of the center plate with magnetic poles of repulsive polarities facing each other, a voice coil in which a magnetic field that is formed by the magnetic circuit unit is interlinked with at least a portion of an alternating magnetic field produced, a vibrating plate connected to the voice coil, and a set of resilient supporting members arranged plane-symmetrically with respect to the outer peripheral surface of the vibrating plate for movably supporting the outer periphery of the vibrating plate. The vibrating plate is movably supported by a set of resilient supporting members arranged plane-symmetrically to suppress the rolling of the vibrating plate during vibrations to realize stable vibrations of the vibrating plate.

13 Claims, 10 Drawing Sheets

SPEAKER AND SPEAKER APPARATUS

BACKGROUND OF THE INVENTION

1. Field of the Invention

This invention relates to a speaker for transducing electrical signals into an acoustic sound, and a speaker apparatus employing this speaker.

2. Description of the Related Art

There has hitherto been proposed a speaker apparatus having a magnetic circuit in which a pair of magnets are arranged with the magnetic poles of repulsive polarities facing each other with a center plate in-between to form a repellant magnetic field. Typical of the speaker apparatus of this sort is shown in Japanese Laying-Open Patent H-6-233383. Referring to FIG. 1, a speaker apparatus 101 disclosed in this publication includes a vibrating system 105 including a vibrating plate, a magnetic circuit 106 for driving the vibrating system 105, and a frame 107 for supporting the vibrating system 105 and the magnetic circuit 106. Referring to FIG. 1, this vibrating system 105 includes a substantially frusto-conical main vibrating plate 110, having a center through-hole, a substantially frusto-conical sub-vibrating plate 111, mounted on the main vibrating plate 110 with its center axis coincident with the main vibrating plate 110, a dome-shaped cap 112, provided for closing the through-hole of the main vibrating plate 110, a cylindrically-shaped bobbin 113, connected to the center of the main vibrating plate 110, a resilient edge 114 connected to the outer edge of the main vibrating plate 110, and a flexible vibration-absorbing damper 115 provided on the bobbin 113.

Still referring to FIG. 1, the magnetic circuit 106 includes a voice coil 119 fed with the driving current proportionate to the acoustic signals driving the vibrating system 105, a center plate 120 constituting a magnetic path and a pair of magnets 121, 122 providing magnetic flux to the center plate 120. The voice coil 119 is placed around the outer rim of the bobbin 113 of the vibrating system 105 and is provided on the outer rim of the center plate 120 and the magnets 121, 122. The voice coil 119 has its both ends connected via braided wires to a connecting portion, not shown, provided on the outer rim of the frame 107. The center plate 120 is formed as a disc from a magnetic material. The magnets 121, 122 are formed as discs and are arranged with the centers thereof coincident with the center of the center plate 120, with the center plate 120 in-between, so that the magnetic poles of repulsive polarities face each other. Referring to FIG. 1, a holder 108 for holding the main vibrating plate 110 is provided at an opening end of the frame 107. To this holder 108 is secured the outer rim of the edge of the main vibrating plate 110 via a ring-shaped gasket, 114. At a mid portion on the bottom surface of the frame 107 is formed a supporting lug for supporting the magnetic circuit 106.

If the driving current is fed to the voice coil 119 of the above-described speaker apparatus 101, the voice coil 119 is vibrated in accordance with Flemings left hand rule. The main vibrating plate 110 and the sub-vibrating plate 111 are vibrated as a result of the vibrations of the voice coil 119.

There is also known a speaker apparatus as disclosed in Japanese Laying-Open Patent H-6-233384. This speaker apparatus 102 includes a vibrating system 125, having, a magnetic circuit 126 for driving the vibrating system 125, a magnetic circuit 126 for driving the vibrating system 125 and a pair of frames 127, 128 supporting the vibrating system 125 and the magnetic circuit 126, as shown in FIG. 2. The vibrating system 125 includes a substantially flat-plate-shaped vibrating plate 130, having a center through-hole, a cylindrically-shaped bobbin 131, placed within the through-hole of the vibrating plate 130, a dome-shaped cap 132, closing one opening end of the bobbin 131, a resilient supporting member 133, mounted in continuation to the outer rim of the vibrating plate 130, and a pair of resilient vibration-absorbing dampers 134, 135, attached to the bobbin 131, as shown in FIG. 2.

The magnetic circuit 126 includes a voice coil 139, fed with the driving current proportionate to acoustic signals used for the driving system 125, a center plate 140 constituting the magnetic path, and a pair of magnets 141, 142 for providing the magnetic flux to the center plate 140. The voice coil 139 is placed around the outer periphery of the bobbin 131 of the vibrating system 125, and is arranged on the outer periphery of the bobbin 131 of the vibrating system 125, as shown in FIG. 2. The voice coil 139 has its both ends connected via a braided wire to a connecting portion, not shown, provided on the outer periphery of the frame 127. The center plate 140 is formed in a disc shape from a magnetic material, The magnets 141, 142 are formed in a disc shape and are arranged with the center axes thereof coincident with the center of the center plate 140, on both sides of the center plate 140, so that the magnetic poles of repulsive polarities will face each other, with the center plate 140 in-between.

The frames 127, 128 are assembled with each other to support the vibrating plate 130 and the magnetic circuit 126 therein, as shown in FIG. 2. The frames 127, 128 are each formed with a holder 129 for holding the vibrating plate 130 with the outer rim portion of the vibrating plate 130 being supported by the holder 129 via a resilient supporting member 133. A supporting lug for supporting the magnetic circuit 126 is formed at a mid portion on the bottom surface of the frame 128.

The above-described speaker apparatus 102 has its voice coil 139 fed with the driving current proportionate to the acoustic signals, whereby the voice coil 139 is vibrated in accordance with Flemings left hand rule. The vibrating plate 130 is vibrated with vibrations of the voice coil 139 to generate the acoustic sound.

There is another type of the speaker apparatus disclosed in Japanese Laying-Open Patent H-6-284499. This speaker apparatus 103 includes a vibrating system 145, including, a magnetic circuit 146 for driving the vibrating system 145 and a pair of frames 147, 148 for supporting the vibrating system 145 and the magnetic circuit 146, as shown in FIG. 3.

The vibrating system 145 has a set of substantially planar plate-shaped vibrating plates 150, 151, each having a center through-hole, and a resilient supporting member 153 mounted on the outer periphery of the vibrating plates 150, 151, as shown in FIG. 3. The vibrating plates 150, 151 are bonded to each other with a pre-set gap in-between. The resilient supporting member 153, carrying at its one end the vibrating plates 150, 151, has its other end mounted on the frames 147, 148.

Referring to FIG. 3, the magnetic circuit 146 includes a voice coil 159, fed with the driving current proportionate to the acoustic signals driving the vibrating system 125, a center plate 160 constituting the magnetic path, and a pair of magnets 161, 162 providing the magnetic flux to this center plate 160. The voice coil 159 is provided providing the inner periphery of the vibrating plates 150,151 of the vibrating system 145, and is arranged on the outer rim portions of the center plate 160 and the magnets 161, 162. These magnets 161, 162 are formed in a ring shape and are arranged with the center axes thereof coincident with the center of the center plate 160, on both sides of the center plate 160, so that the magnetic poles of repulsive polarities will face each other, with the center plate 160 in-between.

The frames 147, 148, having the same shape, are assembled with each other to support the vibrating system 145 and the magnetic circuit 146 therein. The frames 147, 148 are each formed with a holder 149 for holding the vibrating plates 150, 151. To this holder 149 are secured outer rims of the vibrating plates 150, 151 via resilient supporting member 153. The frames 147, 148 are each formed at mid portions of the bottom surfaces thereof with supporting lugs, not shown, adapted for supporting the magnetic circuit 126.

The above-described speaker apparatus 103 has its voice coil 159 fed with the driving current proportionate 'to the acoustic signals, whereby the voice coil 159 is vibrated in accordance with Flemings left hand rule. The vibrating plates 150, 151 are vibrated with vibrations of the voice coil 159 to generate the acoustic sound.

The magnetic circuits 106, 126, 146, making up the speaker apparatus 101, 102, 103, respectively, are effective to reduce the size of the entire apparatus.

The speaker apparatus 101 of FIG. 1, reduced in thickness by the magnetic circuit 106, has the bobbin 113 supported by the damper 115, and the sub-vibrating plate 111 is provided on the bobbin 113, so that it has a drawback that the vibrating system 105 has an increased thickness in the direction along the amplitude of the vibrating system 105.

The speaker apparatus 102 of FIG. 2, reduced in thickness by the magnetic circuit 126, is of a structure in which the dampers 134, 135 and the vibrating plate 130 are stacked along the amplitude direction of the vibrating system 125, so that it has a drawback that it has an increased thickness along the amplitude direction.

The speaker apparatus 103 of FIG. 3, reduced in thickness by the magnetic circuit 146, is not provided with dampers adapted for holding the voce coil 159 at a pre-set position in the magnetic field, so that it is susceptible to rolling on vibration of the vibrating plate 150 with an increased amplitude, with the result that it cannot reproduce the acoustic sound to high sound quality. This speaker apparatus 103 has a drawback that the voice coil 159 tends to be destroyed due to rolling of the vibrating plate 150 such that the apparatus is poor in resistance against high input. The speaker apparatus also has a drawback that air in an enclosure tends to leak from the gap between the voice coil 159 and the center plate 160, thereby distorting the reproduced sound.

The magnetic flux distribution in the magnetic circuits 106, 126, 146 of the speaker apparatus 101 to 103 is explained with reference to FIG. 4, in which the ordinate denotes the position along the thickness direction of a magnetic circuit parallel to the amplitude direction of the vibrating system and the abscissa denotes the orientation of the magnetic flux. Also, in FIG. 4, the arrows indicate the direction of the magnetic field. In the magnetic circuits 106, 126, 146, provided in the speaker apparatus 101, 102, 103, respectively, the magnetic flux density is maximum in the vicinity of the outer rim portions of the center plates 120, 140, 160, respectively, as shown in FIG. 4. The magnetic circuits 106, 126, 146 are designed so that the center along the thickness direction of the center plates 120, 140, 160 represents the position P3 having the maximum magnetic flux density.

With the magnetic circuits 106, 126, 146, the magnetic flux is decreased gradually in the direction from outer rim portions of the center plates 120, 140, 160 to the outer rims towards the magnets 121, 122, 141, 142, 161, 162, away from the center plates, with the magnetic flux becoming zero at mid portions along the direction of thickness of the outer rims of the magnets 121, 122, 141, 142, 161, 162. Also, with the magnetic circuits 106, 126, 146, the direction of the magnetic field indicated by arrows in FIG. 4 is inverted in a direction proceeding from the mid portion along the thickness of the outer rims of the magnets 121, 122, 141, 142, 161, 162 away from the center plates 120, 140, 160, with the magnetic flux in the reverse direction becoming maximum at the ends of the magnets 121, 122, 141, 142, 161, 162 and becoming zero at a position further away from the center plates 120, 140, 160.

In a large amplitude speaker apparatus, shown in FIGS. 5A to 5C, the length along the amplitude direction needs to be set to a larger value so that the magnetic flux density on the voice coil 170 mounted on the vibrating plate 172 will be constant irrespective of the position of the vibrating voice coil 170 along the amplitude direction, as shown in FIGS. 5A to 5C. Thus, it is difficult to reduce the thickness of the apparatus. With the speaker apparatus, having the magnetic flux distribution shown in FIG. 4, the magnetic flux lines having the reverse direction in a region on both sides along the direction of thickness of the center plate 171 act for obstructing the movement of the voice coil 170 to render it difficult to produce optimum acoustic characteristics.

SUMMARY OF THE INVENTION

It is therefore an object of the present invention to provide a speaker and a speaker apparatus in which it is possible to reduce the thickness and weight of the entire apparatus.

It is another object of the present invention to provide a speaker and a speaker apparatus in which it is possible to reproduce the sound to high sound quality without distortion.

It is still another object of the present invention to provide a speaker and a speaker apparatus in which it is possible to assure sufficient strength against large amplitudes to improve durability.

It is yet another object of the present invention to provide a speaker apparatus in which a speaker can be repaired or exchanged easily.

The present invention provides a magnetic circuit unit having a center plate of a magnetic material and a set of magnets arranged on both sides of the center plate with magnetic poles of repulsive polarities facing each other, a voice coil in which a magnetic field formed by the magnetic circuit unit is interlinked with at least a portion of an alternating magnetic field produced, a vibrating plate connected to the voice coil, and a set of resilient supporting members arranged plane-symmetrically with respect to the outer peripheral surface of the vibrating plate for movably supporting the outer periphery of the vibrating plate.

With the present speaker, the outer rim portion of the vibrating plate arranged plane-symmetrically on the outer rim portions of the vibrating plate is movably supported by a set of resilient supporting members to suppress the rolling of the vibrating plate during vibrations to realize stable oscillations of the vibrating plate.

The magnetic circuit unit is formed so that the magnetic flux density in the vicinity of the crossing point of a junction surface between the center plate and the set of the magnets and the voice coil will be maximum. In this manner, the magnetic flux density is maximum along the outer periphery of two points line-symmetrical with respect to the centerline in the thickness direction of the center plate, so that a large driving power can be developed to enable the driving plate to be driven at a larger amplitude, even with the use of a voice coil of a smaller winding width.

The speaker apparatus according to the present invention includes the above-described speaker and a casing for supporting this speaker. The speaker includes a magnetic circuit unit on the back surface of the casing lying in back of the speaker.

The casing includes a front baffle plate and a rear baffle plate, arranged as a pair ahead and in back of the speaker. The rear baffle plate has a vibrating system supporting unit for supporting the vibrating system of the speaker and a circuit supporting unit for supporting the magnetic circuit unit.

With this speaker apparatus, the magnetic circuit unit of the speaker is directly supported by the back surface of the casing to enable the thickness of the vibrating system along the amplitude direction and hence the thickness of the entire apparatus to be reduced.

The casing of the speaker apparatus according to the present invention includes a front baffle plate and a rear baffle plate, arranged as a pair ahead and in back of the speaker. The rear baffle plate has a speaker supporting member for supporting the speaker vibrating system and the magnetic circuit unit and a baffle member detachably mounted on the speaker supporting member, so that the speaker can be easily mounted on and dismounted from the speaker by the attachment/detachment of the speaker supporting member.

Other objects and advantages of the invention will become clear front the following description of the preferred embodiments and the claims.

DESCRIPTION OF THE PREFERRED EMBODIMENTS

Figure 1:
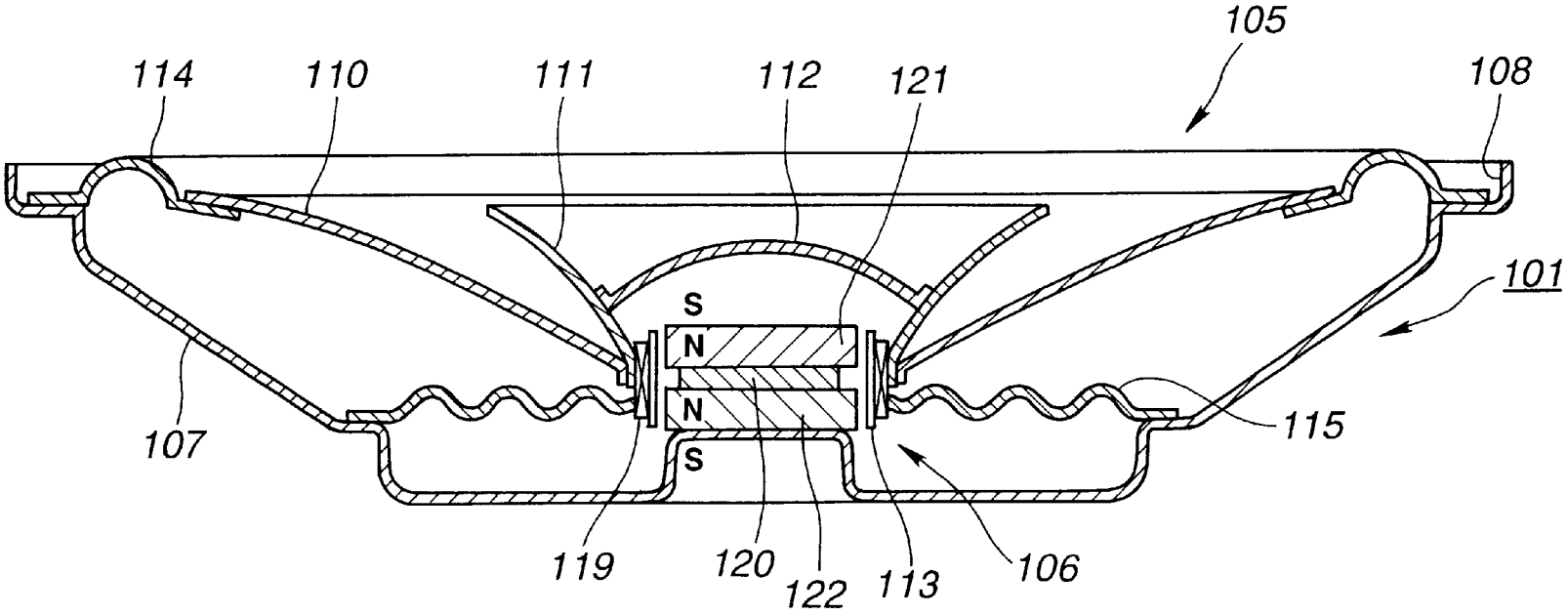
FIG.1 (PRIOR ART)
FIG. 1 is a cross-sectional view showing an example of a conventional speaker apparatus.
Figure 2:
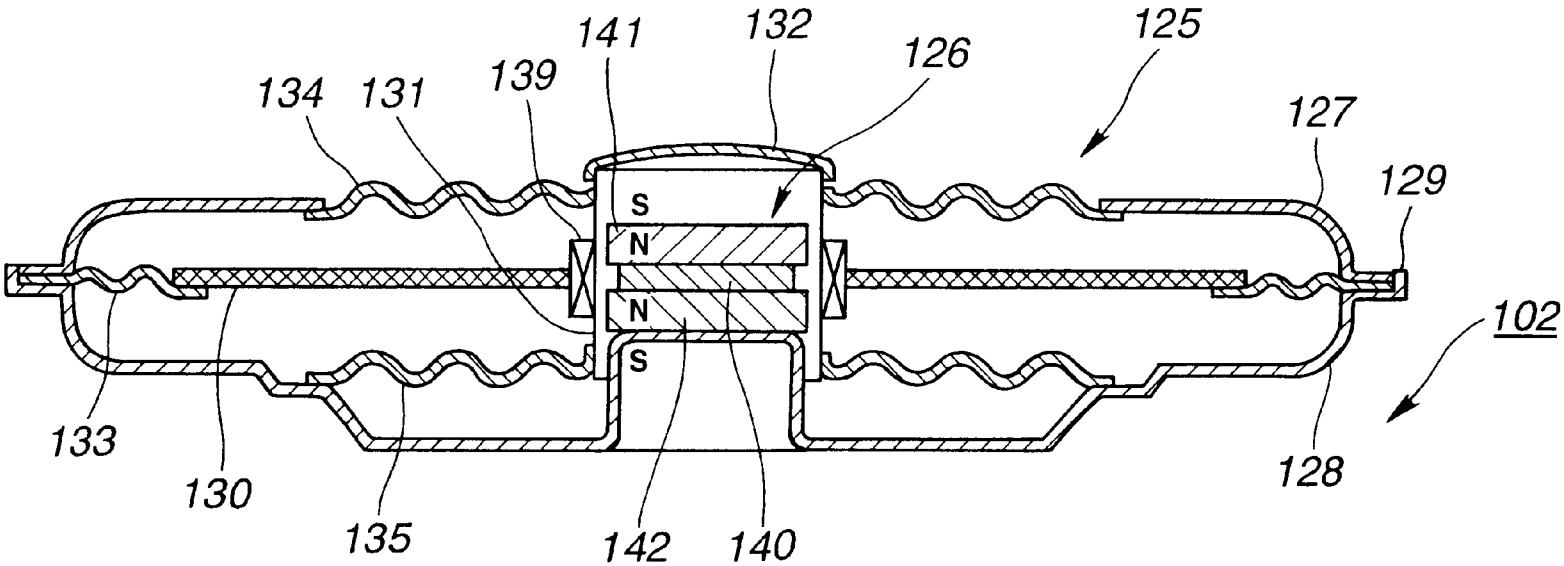
FIG.2 (PRIOR ART)
FIG. 2 is a cross-sectional view showing an example of another conventional speaker apparatus.
Figure 3:
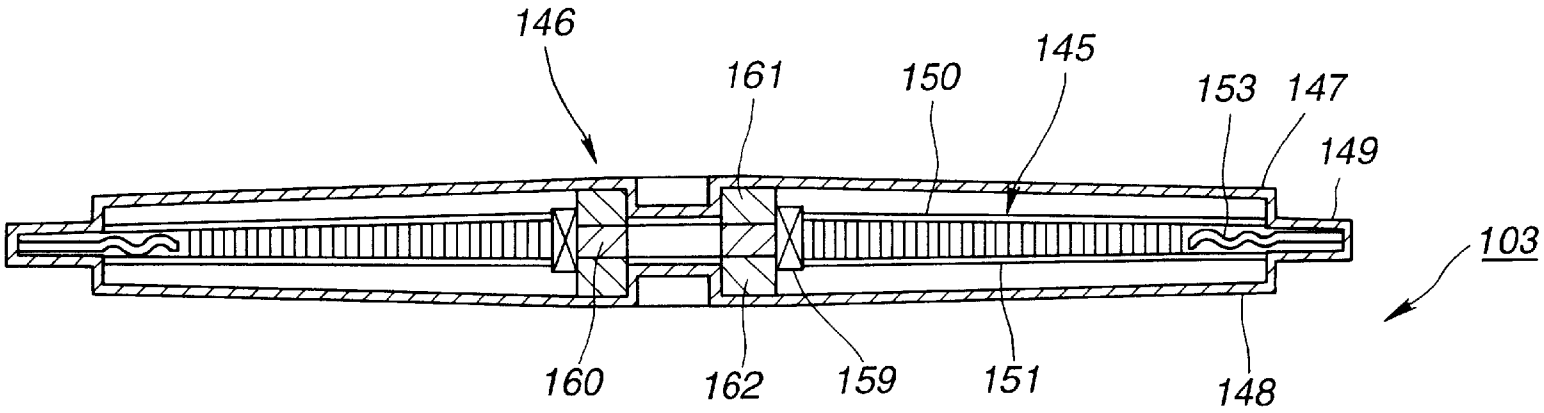
FIG.3 (PRIOR ART)
FIG. 3 is a cross-sectional view showing a further example of another conventional speaker apparatus.
Figure 4:
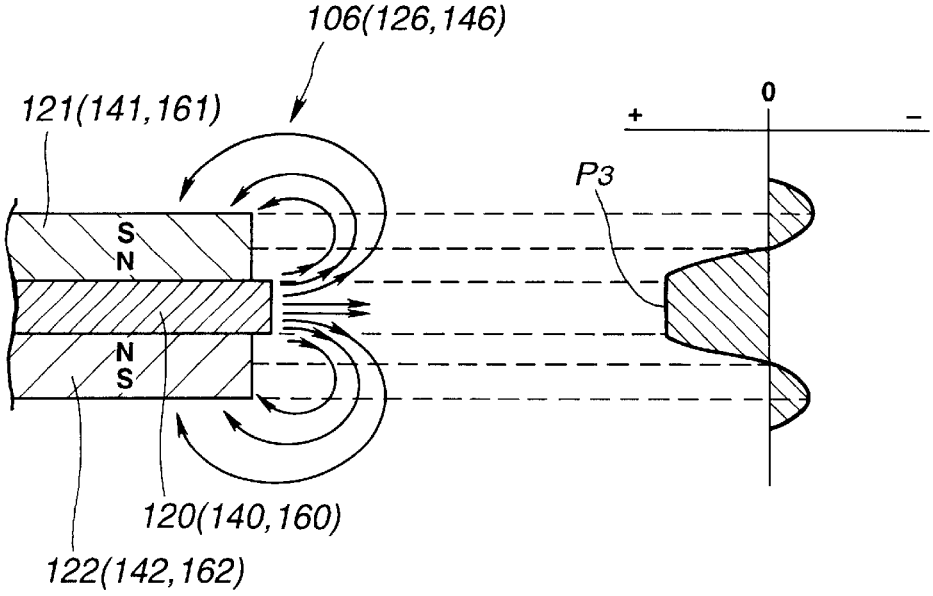
FIG.4 (PRIOR ART)
FIG. 4 illustrates the magnetic field of a magnetic circuit of a conventional speaker apparatus.
Figures 5A, 5B, 5C:
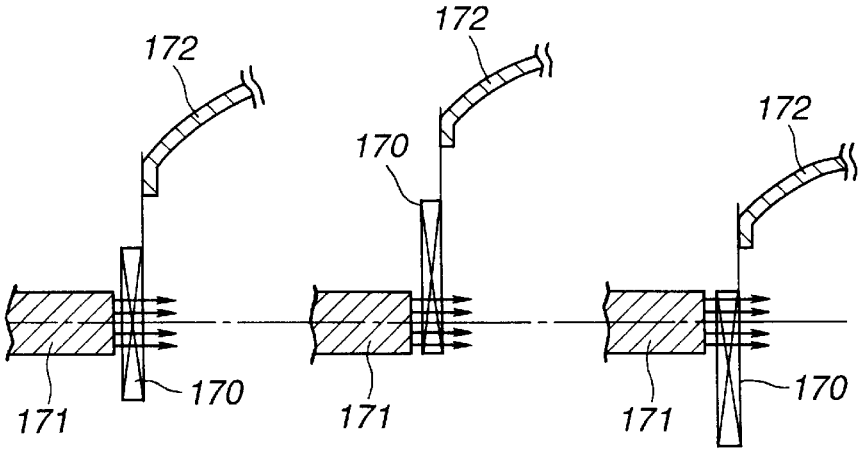
FIG.5A (PRIOR ART) FIG.5B (PRIOR ART) FIG.5C (PRIOR ART)
FIGS. 5A to 5C illustrate the state of a voice coil in the magnetic field in the magnetic circuit of a conventional speaker apparatus.

Referring to the drawings, a preferred embodiments of a speaker according to the present invention will be explained in detail.

Figure 6:
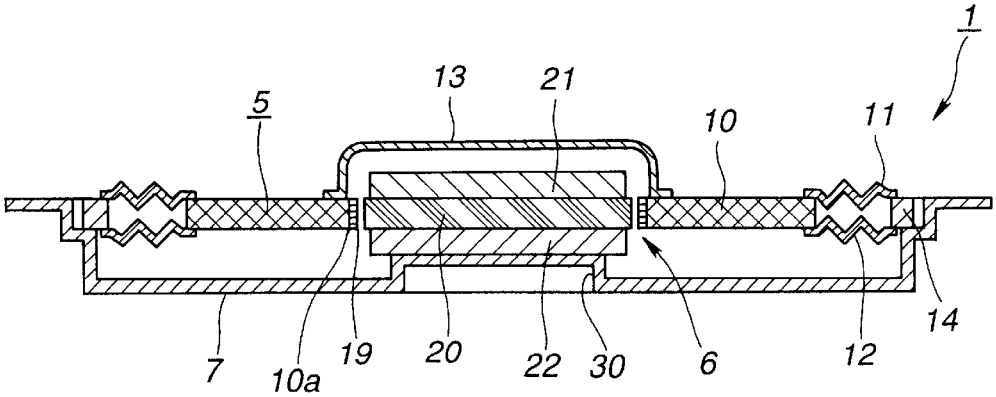
FIG. 6 is a cross-sectional view showing a speaker according to an embodiment of the present invention.

A speaker 1 according to the present invention includes a vibrating system 5, having a magnetic circuit 6 for driving the vibrating system 5, and a frame 7 for supporting the vibrating system 5 and the magnetic circuit 6, as shown in FIG. 6.

The vibrating system 5 includes a ring-shaped vibrating plate 10, having a center through-hole 10*a*, a set of resilient supporting members 11, 12 for movably supporting the outer periphery of the vibrating plate 10 and a tubular cap 13 having its opening end secured around a through-hole 10*a* of the vibrating plate 10, as shown in FIG. 6. The vibrating plate 10 is formed by a lightweight planar sheet member of a desired thickness having a honeycomb or foamed mica structure presenting voids in the interior or in its surface. Within the through-hole 10*a* of the vibrating plate 10 is mounted a magnetic circuit 6. The resilient supporting members 11, 12 are formed of an elastic material in concentric corrugated or rolled configurations, as shown in FIG. 6. These resilient supporting members 11, 12 are provided line-symmetrically and parallel to each other with respect to the centerline along the direction of thickness of the vibrating plate 10. Each of the resilient supporting members 11, 12 has its one end attached to both ends along the direction of thickness of the outer rim portions of the vibrating plate 10, while having its opposite end mounted on a ring-shaped edge ring 14 provided on the frame 7. The cap 13 is formed of, for example, foamed mica, and is mounted for closing the through-hole 10*a* of the vibrating plate 10 for covering the front side of the magnetic circuit 6. This cap 13 is provided so that its bottom surface clears the major surface of the magnet by a distance not less than the maximum amplitude of the vibrating plate 10, in order to prevent the cap 13 from colliding against a magnet etc of the magnetic circuit 6 when the vibrating plate 10 is vibrated to its maximum amplitude. With the magnetic circuit 6, air leakage from the inside of an enclosure from an interstice between the vibrating plate 10 and the magnetic circuit 6 is prohibited by the cap 13.

With the present speaker 1, in which the resilient supporting members 11, 12 support the vibrating plate 10 at a pre-set distance therebetween along the direction of thickness of the vibrating plate 10, it is possible to maintain a voice coil provided in the through-hole 10*a* of the vibrating plate 10 as later explained at an optimum position in the magnetic field, thus suppressing the rolling produced on vibration of the vibrating plate 10 to a larger amplitude. Thus, with the speaker apparatus, devoid of the dampers 115, 134, 135 provided on the above-described conventional speaker apparatus, rolling can be prohibited on vibration of the vibrating plate 10 to large amplitudes.

Referring to FIG. 6, the magnetic circuit 6 is arranged in the through-hole 10*a* of the vibrating plate 10 of the vibrating system 5, and includes a voice coil 19 for vibrating the vibrating plate 10, a center plate 20 for constituting the magnetic path, and a pair of magnets 21, 22 for providing the magnetic flux to the center plate 20. The voice coil 19 is mounted on the inner peripheral surface of the through-hole 10*a* of the vibrating plate 10 of the vibrating system 5 so that the centerline along the direction of the winding width is coincident with the centerline along the direction of thickness of the vibrating plate 10. The winding width of the voice coil 19 is selected to be not larger than the thickness of the center plate 20. The center plate 20 is of a disc shape formed of a soft magnetic material, such as a hot forged steel plate, as shown in FIG. 6. The magnets 21, 22 are anisotropic rare earth element magnets, obtained on firing, such as neodymium sintered magnets, and are each in a disc shape having an outer diameter slightly smaller than the outer diameter of the center plate 20.

Figure 7:
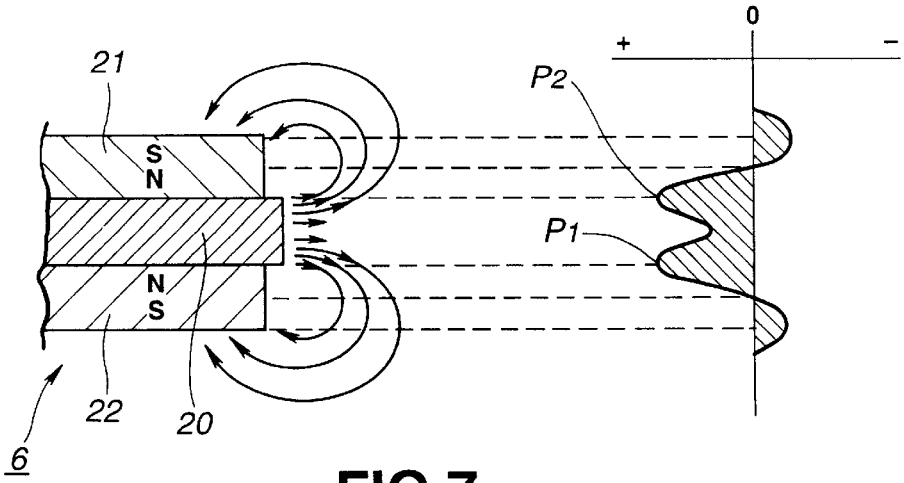
FIG. 7 illustrates the magnetic field and the magnetic flux distribution of a magnetic circuit provided on the speaker according to the present invention.

Referring to FIGS. 6 and 7, the magnets 21, 22 are arranged on either sides of the center plate 20, with the center plate 20 in-between, so that the magnetic poles of repulsive polarities of the magnets will face each other. The outer rim of the center plate 20 is protruded from the outer rims of the magnets 21, 22. That is, the sides of the magnets 21, 22 towards the center plate 20 are magnetized to the N pole, while the opposite sides thereof are magnetized to the S pole.

The magnetic flux distribution of the above-described magnetic circuit 6 is now explained by referring to the drawings. In FIG. 7, the ordinate and the abscissa denote a position along the direction of thickness of the magnetic circuit 6 parallel to the direction of amplitude of the vibrating system 5 and the direction of the magnetic flux, respectively. Also, in FIG. 7, the arrows indicate the direction of the magnetic lines of force. Referring to FIG. 7, the magnetic circuit 6 is designed to give a magnetic flux distribution such that apex points P1 and P2 representing the maximum magnetic flux density in the magnetic field are formed at two points line-symmetrical with respect to the centerline along the direction of thickness of the center plate 20, as shown in FIG. 7. With the magnetic circuit 6, the two points P1, P2 with the maximum magnetic flux density are positioned on both ends of the center plate 20 by suitably setting the thicknesses of the center plate 20 and the magnets 21, 22.

Although the magnetic flux density is maximum at both ends of the center plate 20, there may be occasions wherein the maximum magnetic flux density positions are deviated from both ends of the center plate 20, depending on the magnitude of the chamfered portions provided on both edges of the center plate 20 or on magnetic properties of the magnets 21, 22.

Figure 8:
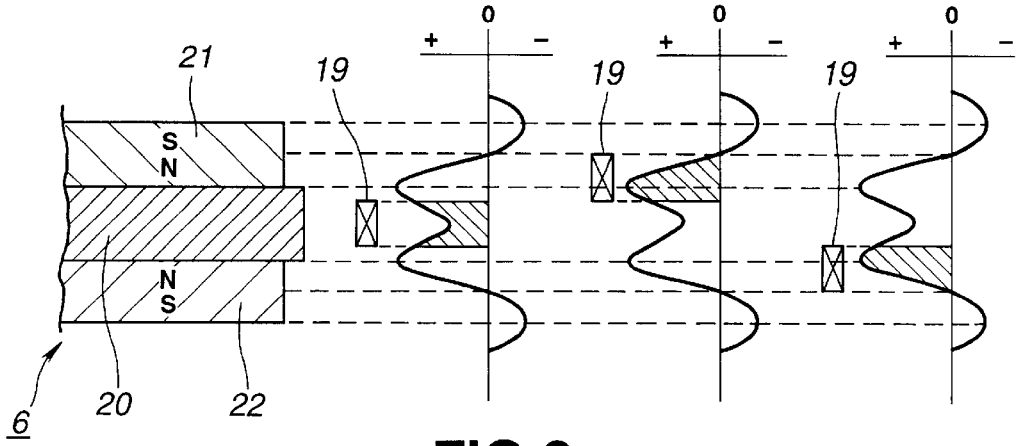
FIG. 8 shows the state of the voice coil in the magnetic field of the magnetic circuit shown in FIG. 7.

Referring to FIG. 7, showing the magnetic flux density of the magnetic circuit 6, the magnetic flux density at amid portion along the direction of thickness of the center plate 20 is small, with the magnetic flux density becoming gradually larger towards both ends along the thickness of the center plate 20. Also, with the present magnetic circuit, the magnetic flux density becomes gradually smaller from both ends along the direction of thickness of the center plate 20 towards the magnets 21, 22, with the magnetic flux being inverted in its direction at mid portions along the direction of thickness of the magnets 21, 22, and becoming smaller as from the mid portions. With the magnetic circuit 6, the magnetic flux density is then increased in a direction away from the ends of the magnets 21, 22. Of the magnetic circuit 6 of the speaker apparatus 1, constructed as described above, the voice coil 19 vibrated in the magnetic field is explained as to its vibrating state with reference to the drawings. In FIG. 8, the ordinate and the abscissa denote the position along the thickness of the magnetic circuit 6 parallel to the direction of amplitude of the vibrating system 5 and the direction of the magnetic flux, respectively.

Referring to FIG. 8, the magnetic flux in an area between the apex points P1 and P2 acts on the voice coil 19 when the voice coil 19 is positioned at a mid portion along the direction of thickness of the center plate 20. The magnetic flux in the area of the apex point P1 or P2 acts on the voice coil 19 when the voice coil 19 is positioned at each end along the direction of thickness of the center plate 20. Also, in the magnetic circuit 6, the total effective magnetic flux acting on the voice coil 19 is always constant irrespective of the position in the amplitude range in which the voice coil 19 is positioned at the time of vibrations.

If the driving current corresponding to acoustic signals is fed to the voice coil 19, the voice coil 19 is moved in accordance with Flemings left hand rule. The vibrating plate 10 is vibrated as a result of the movements of the voice coil 19.

The center plate may be formed so that its outer diameter of its both sides line-symmetrical with respect to the centerline along its thickness will be larger than the outer diameter at a mid portion along the thickness so that the magnetic flux will be concentrated towards both ends of the center plate along the direction of thickness.

Figure 9:
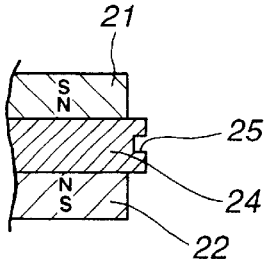
FIG. 9 is a cross-sectional view showing a typical center plate of a magnetic circuit unit.

That is, the magnetic circuit 6 may be provided with a center plate 24 configured as shown in FIG. 9. This center plate 24 has an annular magnetic flux adjustment groove 25 at a mid portion along the direction of thickness for extending towards the outer rim, as shown in FIG. 9. That is, the center plate 24 is configured for weakening the magnetic flux at a mid portion along the thickness.

Figure 10:
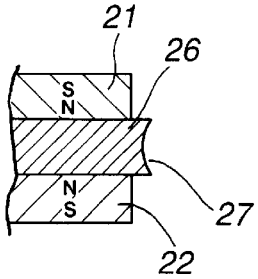
FIG. 10 is a cross-sectional view showing another typical center plate.
Figure 11:
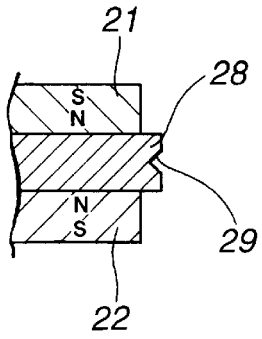
FIG. 11 is a cross-sectional view showing a further typical center plate.

The magnetic circuit 6 may also be provided with a center plate 26 shown in FIG. 10. This center plate 26 has a magnetic flux adjustment groove 27 of an arcuate cross-section in which the outer diameter of the center plate 26 is minimum at a mid portion along the thickness, with the outer diameter becoming progressively larger towards both ends in the direction along the thickness, as shown in FIG. 10. The magnetic circuit 6 may also be provided with a center plate 28, as shown in FIG. 11. This center plate 28 has a substantially vee-shaped magnetic flux adjustment groove 29 extending at a mid position along the direction of thickness towards the outer rim portions, as shown in FIG. 11.

The frame 7 is formed of a metallic material as a bottomed cylinder, at a mid portion on the bottom surface of which a supporting protrusion 30 is formed for supporting the magnetic circuit 6. On the outer rim of the frame 7, there is provided a connection terminal to which both ends of the voice coil 19 are connected via braided wires, not shown.

With the speaker 1 of the present invention, as described above, in which the vibrating plate 10 vibrated by the magnetic circuit 6 is supported by the paired resilient supporting members 11, 12 to reduce the thickness and the weight of the entire apparatus. With the present speaker 1, having the paired resilient supporting-members 11, 12 for supporting the vibrating plate 10 at the positions spaced a pre-set distance from each other in the direction of thickness of the vibrating plate 10, there is no risk of the generation of mechanical distortions ascribable to a non-linear amplitude, while it is possible to suppress the rolling operation of the vibrating system 5, so that the acoustic sound of optimum sound quality free of distortion may be produced. Moreover, the vibrating plate can be vibrated to larger amplitudes with high efficiency by the driving current to give an optimum sound pressure frequency characteristics.

Also, the speaker 1 according to the present invention includes the paired resilient supporting members 11, 12, arranged line-symmetrically with respect to the centerline along the thickness direction of the vibrating plate 10, as a mechanical supporting system for supporting the vibrating system 5, thus assuring optimum linear amplitude characteristics. The result is the reduced distortion of the reproduced sound and the reproduced sound with optimum sound quality.

Also, with the speaker 1 of the present invention, the magnetic flux density becomes maximum at both ends symmetrical with respect to the thickness of the center plate 20 of the magnetic circuit 5 to suppress the distortion otherwise produced by non-symmetry of the magnetic flux distribution to reduce the distortion of the playback sound to give the sound with the optimum sound quality.

With the speaker of the present invention, in which the voice coil 19 is directly attached to the through-hole 10*a* of the vibrating plate 10, it is possible to reproduce the acoustic sound exhibiting high fidelity with respect to the input signal.

Also, with the speaker of the present invention, in which magnetic circuit is configured so that the apex points P1, P2 with the maximum magnetic field density are formed symmetrically with respect to the centerline of the center plate 20, the effective total magnetic flux at the time of vibrations may be rendered constant even if the winding width of the voice coil 19 is not more than the thickness of the center plate. Thus, it is possible to cause the vibrating plate 10 to be vibrated with larger amplitudes even although the voice coil 19 has a smaller winding width. The result is that the sound with the optimum sound quality may be reproduced with larger amplitudes, while the apparatus in its entirety can be further reduced in thickness and weight.

In the above-described speaker 1, the vibrating system 5 has the cap 13. In a speaker according to a modification, now explained, the speaker is provided with a cap which is in turn provided astride magnets 21, 22 of the magnetic circuit 6 and the through-hole 10*a* of the vibrating plate 10 to support the vibrating plate 10. Since this speaker has a basic structure similar to the above-described speaker 1, corresponding parts are indicated by the same reference numerals and are not specifically explained in detail.

Figure 12:
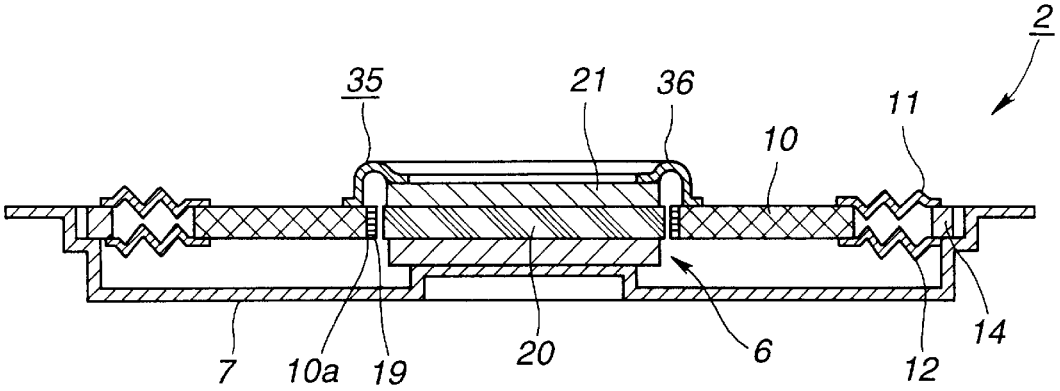
FIG. 12 is a cross-sectional view showing a speaker according to another embodiment of the present invention.

Referring to FIG. 12, the speaker 2 of the present invention has a vibrating system 35 which is provided astride the magnets 21, 22 of the magnetic circuit 6 and the through-hole 10*a* of the vibrating plate 10 for movably supporting the vibrating plate 10. In FIG. 12, the cap 36 is formed to a substantially toroidal shape from an elastic material, and has its outer rim portion secured to the major surface around the through-hole 10*a* of the vibrating plate 10, while having its inner rim secured to the outer rim of the magnet 21 on the forward side of the magnetic circuit 6. That is, the cap 36, movably supporting the vibrating plate 10, acts for positively preventing air in the enclosure from leaking out from the interstice between the through-hole 10*a* of the vibrating plate 10 and the outer periphery of the magnetic circuit 6.

A speaker apparatus employing the inventive speaker is now explained.

Figure 13:
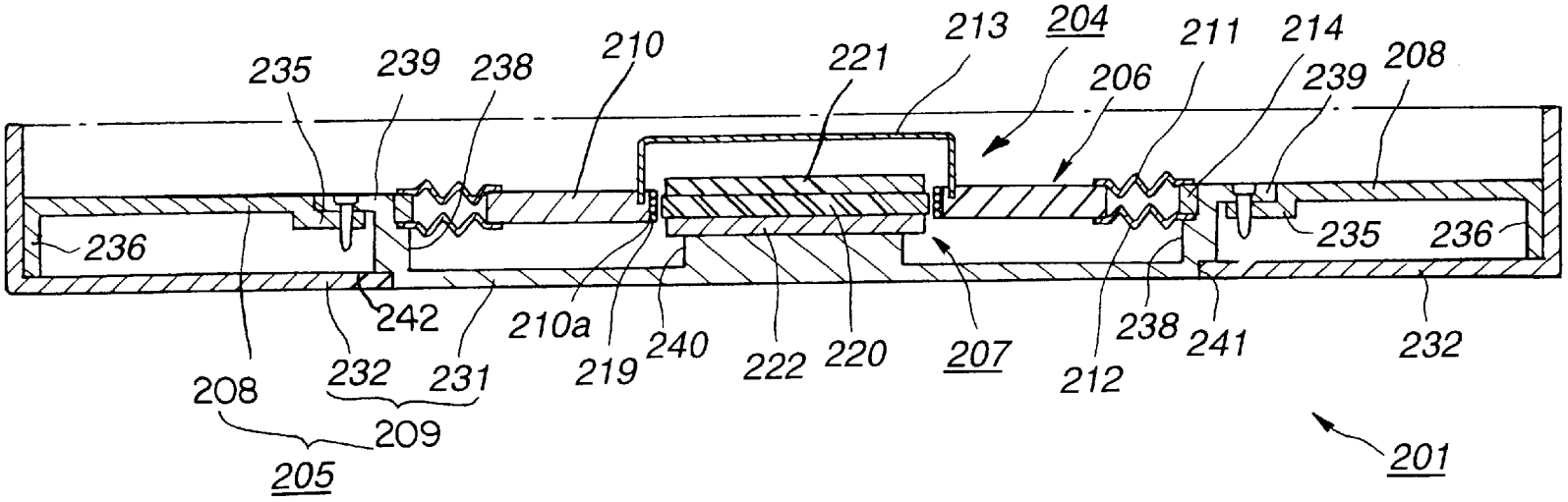
FIG. 13 is a cross-sectional view showing a speaker apparatus according to the present invention.

Referring to FIG. 13, the speaker apparatus includes a speaker 204 having a vibrating system 206 with a vibrating plate and a magnetic circuit 207 for driving the vibrating system 206, as shown in FIG. 13. The vibrating system 206 of the speaker 204 includes a ring-shaped vibrating plate 210, having a center through-hole 210*a*, a set of resilient supporting member 211, 212 for movably supporting the outer rim of the vibrating plate 210, and a bottomed tubular cap 213 having its opening end secured to the through-hole 210*a* of the vibrating plate 210, as shown in FIG. 13. The vibrating plate 210 is formed by a lightweight planar sheet member of a desired thickness having a formed honeycomb or foamed mica structure presenting voids in the interior or in its surface. Within the through-hole 210*a* of the vibrating plate 210 is mounted a magnetic circuit 207.

The resilient supporting members 211, 212 are formed of an elastic material in concentric corrugated or rolled configurations, as shown in FIG. 13. These resilient supporting members 211, 212 are provided line-symmetrically and parallel to each other with respect to the centerline along the direction of thickness of the vibrating plate 210. Each of the resilient supporting members 211,212 has its one end attached to both ends along the direction of thickness of the outer rim portions of the vibrating plate 210, while having its opposite end mounted on a ring-shaped edge ring 214. The cap 213 is formed of, for example, foamed mica, and is mounted for closing the through-hole 210*a* of the vibrating plate 210 for covering the front side of the magnetic circuit 207. This cap 213 is provided so that its bottom surface clears the major surface of the magnet a distance not less than the maximum amplitude of the vibrating plate 210, in order to prevent the cap 213 from colliding against a magnet etc of the magnetic circuit 207 when the vibrating plate 210 is vibrated to its maximum amplitude. With the magnetic circuit 207, air leakage from the inside of an enclosure from an interstice between the vibrating plate 210 and the magnetic circuit 207 is prohibited by the cap 213.

In the speaker 204, used in the present speaker apparatus 201, the resilient supporting members 211,212 support the vibrating plate 210 at a pre-set spacing from each other along the thickness of the vibrating plate 210, whereby the voice coil provided in the through-hole 210*a* of the vibrating plate 210 may be held at an optimum position in the magnetic field thus suppressing the rolling otherwise produced when the vibrating plate 210 is vibrated to large amplitudes.

The magnetic circuit 207 of the speaker 204 is arranged in the through-hole 210*a* of the vibrating plate 210 of the vibrating system 206, as shown in FIG. 13, and includes a voice coil 219 for vibrating the vibrating plate 210, a center plate 220 constituting the magnetic path and a set of magnets 221, 222 according the magnetic flux to the center plate 220.

The voice coil 219 is mounted on the inner periphery of the through-hole 210*a* of the vibrating plate 210 of the vibrating system 206 with the centerline along the direction of the winding width thereof coincident with the centerline along the centerline along the direction of thickness of the vibrating plate 210. The winding width of the voice coil 219 is selected to be not larger than the thickness of the center plate 210.

Figure 14:
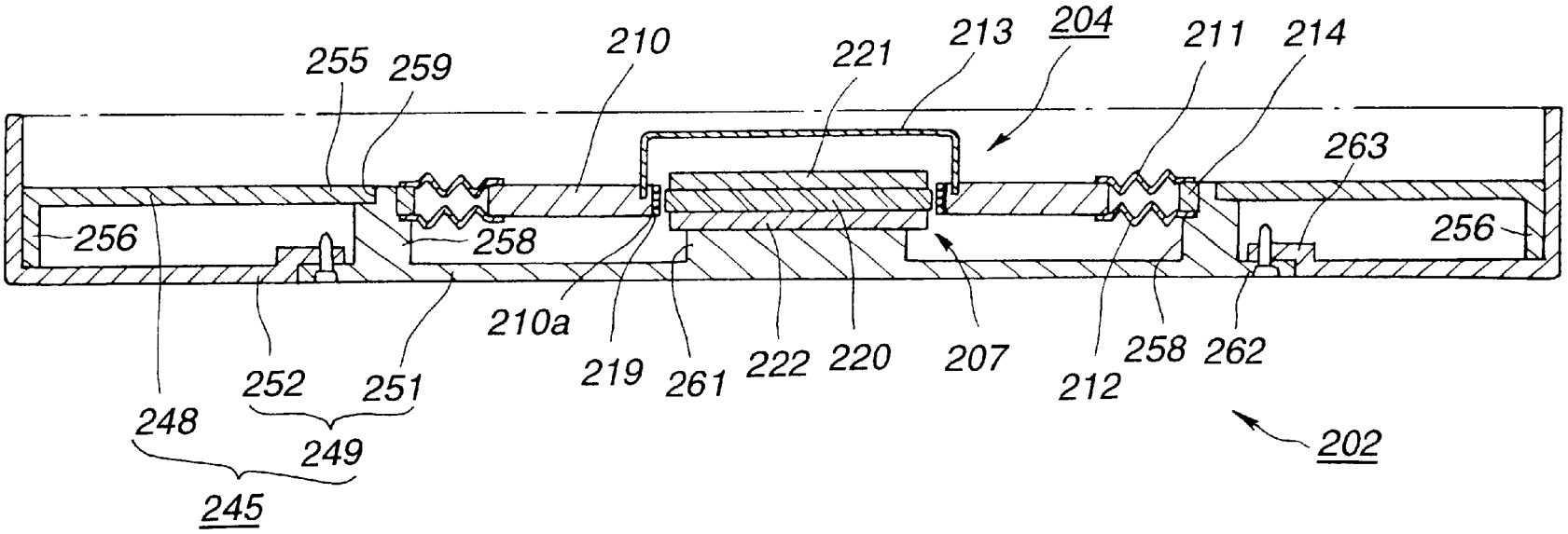
FIG. 14 is a cross-sectional view showing a modification of the speaker apparatus according to the present invention.

The center plate 220 is of a disc shape and is formed of a soft magnetic material, such as a hot forged steel plate, as shown in FIG. 13. The magnets 221, 222 are anisotropic rare earth element magnets obtained on firing, such as neodymium sintered magnets, and are each in a disc shape having an outer diameter slightly smaller than the outer diameter of the center plate 220. The magnets 221, 222 are arranged on either sides of the center plate 20, so that the magnetic poles of repulsive polarities of the magnets will face each other, with the center plate 20 in-between, as shown in FIGS. 13 and 14. The outer rim of the center plate 220 is protruded from the outer rims of the magnets 221, 222. That is, the sides of the magnets 21, 22 towards the center plate 220 are magnetized to the N pole, while the opposite sides thereof are magnetized to the S pole.

If the driving current corresponding to acoustic signals is fed to the voice coil 219, the voice coil 219 is vibrated in accordance with Flemings left hand rule. The vibrating plate 210 is vibrated as a result of the vibrations of the voice coil 219.

The speaker apparatus 201 includes a casing 205 containing the speaker 204 in its inside and a casing 205 supporting the vibrating system 206 of the speaker 204 and the magnetic circuit 207, as shown in FIG. 13. The casing 205 is made up of a set of a front baffle plate 208 and a rear baffle plate 209 combined together and which are mounted at right angles to the direction of amplitude of the vibrating system 206 of the speaker 204, as shown in FIG. 13. The front baffle plate 208 has, in its major surface, an opening in which is mounted the speaker 204 and along which is formed a stationary portion 235 combined with and secured to the rear baffle plate 209, as shown in FIG. 13. On the outer periphery of the major surface of the front baffle plate 208 is formed an abutment 236 abutting against the rear baffle plate 209. The rear baffle plate 209 includes a speaker supporting member 231, supporting the vibrating system 206 and the magnetic circuit 207 of the speaker 204, and a baffle member 232 supporting the speaker supporting member 231.

On the speaker supporting member 231, there are mounted upright a plurality of vibrating system supporting pillars 238, in register with the edge ring 214 of the speaker 204, for extending along the outer periphery of the major surface of the speaker supporting member 231 for supporting the vibrating system 206 of the speaker 204. The edge ring 214 of the vibrating system 206 is fixedly supported by the foremost parts of the vibrating system supporting pillars 238 of the speaker supporting member 231. On the outer periphery of the vibrating system supporting pillars 238 of the speaker supporting member 231 are formed stationary portions 239 combined with and fixedly screwed to a stationary portion 235 of the front baffle plate 208. At a mid portion of the major surface of the speaker supporting member 231 is formed a supporting protrusion 240 supporting the driving circuit 207. To the distal end of the supporting protrusion 240 is abutted and secured a magnet 222 of the magnetic circuit 207. In the outer periphery of the speaker supporting member 231 is formed a supporting groove 241 combined with and supported by the baffle member 232.

In the major surface of the baffle member 232 is formed an opening in which is mounted the speaker supporting member 231, and a shoulder 242 supporting the speaker supporting member 231 is formed for extending along this opening, as shown in FIG. 13. The baffle member 232 is combined with the speaker supporting member 231 at that the shoulder 242 of the speaker supporting member 231 in an airtight manner via a sealing member, not shown. The rear baffle plate 209 is provided with a connection terminal, connected to both ends of the voice coil 219 of the speaker 204 via a braided wire, in a manner not shown. In the opening end of the rear baffle plate 209 is provided a front saran net, not shown, in the manner of closing the opening end of the rear baffle plate 209, for preventing deposition of dust and dirt on the speaker 204 or destruction of the speaker 204.

The state in which the speaker 204 is attached in the casing 205, constructed as described above, is now explained by referring to the drawings.

The speaker 204 is supported by the speaker supporting member 231 of the rear baffle plate 209, as shown in FIG. 13. In the speaker 204, the magnetic circuit 207 is secured to and supported by the supporting protrusion 240 of the speaker supporting member 231, while the edge ring 214 of the vibrating system 206 is secured to and supported by the distal ends of the vibrating system supporting pillars 238. The speaker supporting member 231 supporting the speaker 204 is combined with and fixedly screwed to the stationary portion 235 of the front baffle plate 208 so that the major surface of the vibrating plate 210 of the speaker 204 lies on substantially the same plane as the major surface of the front baffle plate 208.

The speaker supporting member 231, carrying the front baffle plate 208, is supported with the abutment 236 of the front baffle plate 208 abutting against the baffle member 232 and with the shoulder 242 of the baffle member 232 being mounted in the supporting groove 241 via a sealing member, not shown. In the opening end of the baffle member 232 is mounted a front saran net, not shown, for closing the opening end.

In the speaker apparatus 201 according to the present invention, in which the magnetic circuit 207 is directly supported by the rear baffle plate 209 to preclude the necessity of providing a frame supporting the vibrating system 206 and the magnetic circuit 207, the speaker apparatus 201 can be reduced in thickness by an amount corresponding to the thickness of the frame bottom.

That is, since the speaker 201 according to the present invention is not provided with the frame, the inner capacity of the speaker 204 can be increased to improve sound pressure versus frequency characteristics.

In the above-described speaker apparatus 201, the stationary portion 235 of the front baffle plate 208 and the stationary portion 239 of the speaker supporting member 231 of the rear baffle plate 209 are screwed together. However, the speaker supporting member and the baffle member may also be secured to each other without using screws. This modification of the speaker apparatus is now explained by giving a suitable example.

The speaker used in this speaker apparatus is the same as that used in the speaker apparatus 201 and hence the corresponding parts are depicted by the same reference numerals and are not explained in detail.

A speaker apparatus 202 has a casing 245 housing therein a speaker 204 and also supporting a vibrating system 206 and a magnetic circuit 207 of the speaker 204. The casing 245 is made up of a set of a front baffle plate 248 and a rear baffle plate 249 combined together and which are mounted at right angles to the direction of amplitude of the vibrating system 206 of the speaker 204, as shown in FIG. 14. The front baffle plate 248 has, in its major surface, an opening in which is mounted the speaker 204 and along which is formed a stationary portion 255 combined with and secured to the rear baffle plate 249, as shown in FIG. 14. On the outer periphery of the major surface of the front baffle plate 248 is formed an abutment 256 abutting against the rear baffle plate 249.

The rear baffle plate 249 includes a speaker supporting member 251 supporting the vibrating system 206 and the magnetic circuit 207 of the speaker 204 and a baffle member 252 supporting the speaker supporting member 251. On the speaker supporting member 251, there are mounted upright a plurality of vibrating system supporting pillars 258, in register with the edge ring 214 of the speaker 204, for extending along the outer periphery of the speaker supporting member 251 for supporting the vibrating system 206 of the speaker 204. The edge ring 214 of the vibrating system 206 is fixedly supported by the foremost parts of the vibrating system supporting pillars 258 of the speaker supporting member 251. On the outer periphery of the vibrating system supporting pillars 258 of the speaker supporting member 251 is formed a supporting groove 259 combined with a supporting portion of the front baffle plate 248. In the speaker supporting member 251, the supporting portion 255 of the front baffle plate 248 is combined in the supporting groove 259 in an air-tight state maintained by a sealing member, not shown. At a mid portion of the major surface of the speaker supporting member 251 is formed a supporting protrusion 261 supporting the driving circuit 207. To the distal end of the supporting protrusion 261 is abutted and secured a magnet 222 of the magnetic circuit 207. In the outer periphery of the major surface of the speaker supporting member 251 is formed an attachment portion 262 for attachment to the baffle member 252.

In the major surface of the baffle member 252 is formed an opening in which is mounted the speaker supporting member 251, and a stationaryportion263 combined with the baffle member 252 is formed for extending along this opening, as shown in FIG. 14. The rear baffle plate 209 is provided with a connection terminal, connected to both ends of the voice coil 219 of the speaker 204 via a braided wire, in a manner not shown. In the opening end of the rear baffle plate 209 is provided a front saran net, not shown, in the manner of closing the opening end of the rear baffle plate 249, for preventing deposition of dust and dirt on the speaker 204 or destruction of the speaker 204.

The state in which the speaker 204 is attached in the casing 245, constructed as described above, is now explained by referring to the drawings.

The speaker 204 is supported by the speaker supporting member 251 of the rear baffle plate 249, as shown in FIG. 14. In the speaker 204, the magnetic circuit 207 is secured to and supported by the supporting protrusion 261 of the speaker supporting member 251, while the edge ring 214 of the vibrating system 206 is secured to and supported by the distal ends of the vibrating system supporting pillars 238. The speaker supporting member 251 supporting the speaker 204 is supported by the supporting portion 255 of the front baffle plate 248 being combined with and supported by a sealing ember, not shown, so that, with the abutment 256 abutting against the baffle member 252, the major surface of the vibrating plate 210 of the speaker 204 will be on substantially the same horizontal plane as the major surface of the front baffle plate 248. In the opening end of the baffle member 252 is mounted a front saran net, not shown, for closing the opening end.

In the speaker apparatus 202 of the present invention, shown in FIG. 14, as described above, in which the speaker supporting member 251 supporting the speaker 204 can be easily dismounted with respect to the baffle member 252 constituting the speaker 204, it is possible to improve the ease in assembling. Also, with the present speaker apparatus 202, maintenance operations, such as repair, exchange etc of the vibrating system 206 or the magnetic circuit 207 of the speaker 204 may be facilitated.

In the above-described speaker apparatus 202, there is provided the casing 245 having the front baffle plate 248 and the rear baffle plate 249. A further modification of the speaker apparatus, having a modified casing of a simplified structure, is now explained by referring to the drawings. The modified speaker provided in the modified speaker apparatus has the components similar to those of the above-described speaker apparatus 201 and 202 and hence are depicted by the same reference numerals and are not explained specifically.

Figure 15:
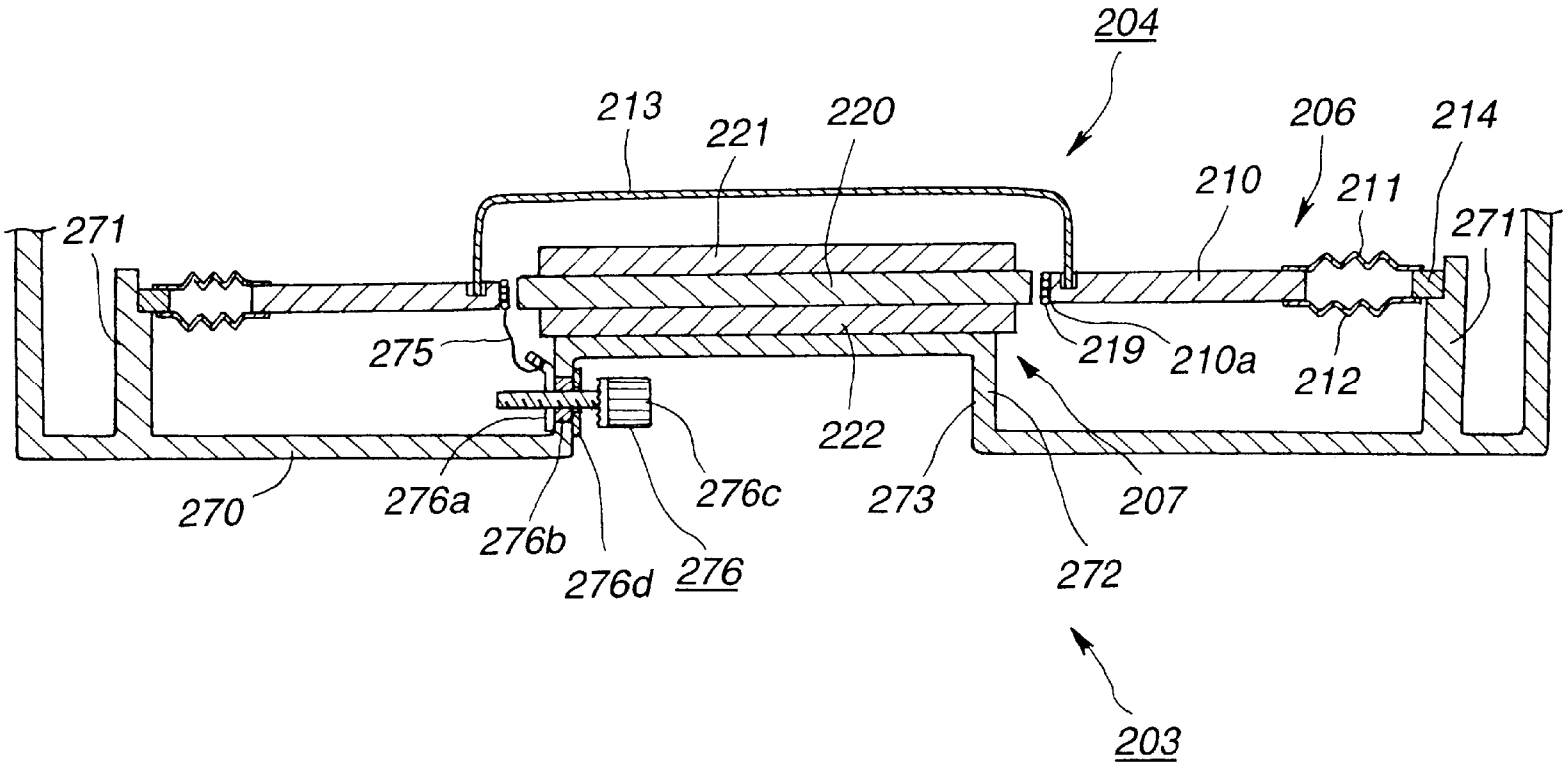
FIG. 15 is a cross-sectional view showing a further modification of the speaker apparatus according to the present invention.

Referring to FIG. 15, a modified speaker apparatus 203 has a casing 270 housing therein a speaker 204 and supporting a vibrating system 206 and a magnetic circuit 207 of the speaker 204, as shown in FIG. 15. The casing 270 is formed of a resin material, such as plastics. The casing 270 is formed with plural vibrating system supporting pillars 271 in register with the edge ring 214 of the speaker 204 for supporting the vibrating system 206 of the speaker 204. The casing 270 is formed with a supporting protrusion 272 adapted to support the magnetic circuit 207 of the speaker 204, as shown in FIG. 15.

On an upstanding wall section of the supporting protrusion 272 of the casing 270 is arranged a connection terminal 276 connected to both ends of the voice coil 219 of the speaker 204 via a braided wire 275, as shown in FIG. 15. The supporting protrusion 272 delimits a terminal housing recess 273 housing the connection terminal 276. Referring to FIG. 15, this connection terminal 276 includes a connection piece 276*a*, to which is connected the braided wire 275, a boss member 276*b* provided on the supporting protrusion 272 in abutment against the connection piece 276*a*, a terminal knob 276*c* threaded into a mating hole in the boss member 276*b*, and a washer 276*d* for connecting a connection line of an external audio signal source, not shown, to this terminal knob 276*c*. This connection terminal 276 also includes a terminal knob 276*c* within the terminal housing recess 273.

The upstanding wall section of the supporting protrusion 272 may be formed at an angle relative to the amplitude direction of the vibrating system 206, in a manner not shown, in order that an end of the terminal knob 276*c* of the connection terminal 276 faces the opening end of the terminal housing recess 273. If the upstanding wall section of the supporting protrusion 272 is formed at an angle relative to the amplitude direction of the vibrating system 206, the connection operation of a connection line to the external power source can be performed easily.

In the opening end of the casing 270 is provided a front saran net, not shown, in the manner of closing the opening end of the casing 270, for preventing deposition of dust and dirt on the speaker 204 or destruction of the speaker 204.

The state in which the speaker 204 is attached in the casing 270, constructed as described above, is now explained by referring to the drawings.

In the speaker 204, both ends of the voice coil 219 are connected via a braided wire 275 to the connection piece 276*a* of the connection terminal 276, as shown in FIG. 15. Also, the magnetic circuit 207 of the speaker 204 is set on and secured to the supporting protrusion 272 of the casing 270, while the edge ring 214 of the vibrating system 206 is secured to the distal end of the vibrating system supporting pillar 271.

With the speaker apparatus of the present invention, since the magnetic circuit is supported on the rear surface of the casing, the thickness of the vibrating system along the amplitude direction can be reduced to reduce the thickness of the entire apparatus.

Also, in the speaker apparatus, in which the unit supporting member supporting the speaker can be attached to and detached from the baffle member of the baffle plate constituting the casing, the maintenance operations, such as speaker repair or exchange, can be facilitated to improve the ease in assembling.

What is claimed is:

1. A speaker comprising:

a magnetic circuit unit having a center plate formed of magnetic material and a set of magnets arranged on both sides of the center plate with magnetic poles of the set of magnets of repulsive polarities facing each other;

a voice coil arranged so that a magnetic field formed by said magnetic circuit unit is interlinked with at least a portion of an alternating magnetic field produced by said voice coil;

a vibrating plate mechanically connected to said voice coil; and a set of resilient supporting members arranged plane-symmetrically with respect to an outer peripheral surface of the vibrating plate for movably supporting said vibrating plate, wherein said center plate is symmetrical with respect to a centerline in a thickness direction and a peripheral groove is formed in an end face at an outer circumference of the center plate.

2. The speaker according to claim 1 wherein said vibrating plate is formed in a substantially planar configuration having a center opening in which said voice coil is mounted.

3. The speaker according to claim 1 wherein said vibrating plate is formed in a substantially planar configuration having a center opening;

said voice coil being arranged in the center opening in the vibrating plate, with a winding width of the voice coil being not larger than a thickness of the center plate.

4. The speaker according to claim 1 wherein said magnetic circuit unit is formed so that a magnetic flux density is a maximum in a vicinity of a crossing point of a junction surface between the center plate and the set of the magnets and the voice coil.

5. The speaker according to claim 4 wherein a winding width of the voice coil is not larger than a thickness of the center plate.

6. The speaker according to claim 4 wherein the vibrating plate is provided with a cap member for covering said magnets on the forward side of the sound radiating direction of the vibrating plate.

7. The speaker according to claim 4 wherein an annular cap member for movably supporting the vibrating plate is provided astride a foremost one of the magnets of the set and the vibrating plate.

8. The speaker according to claim 1 wherein a cap member for movably supporting the vibrating plate is provided astride a foremost one of the magnets of the set and the vibrating plate.

9. A speaker apparatus comprising:

a speaker including a magnetic circuit unit having a center plate formed of magnetic material and a set of magnets arranged on both sides of the center plate with magnetic poles of the set of magnets of repulsive polarities facing each other, wherein said center plate is symmetrical with respect to a centerline in a thickness direction and a peripheral groove is formed in an end face at an outer circumference of the center plate;

a voice coil arranged so that a magnetic field formed by said magnetic circuit unit is interlinked with at least a portion of an alternating fed produced by said voice coil;

a vibrating plate mechanically connected to said voice coil; and a set of resilient supporting members for movably supporting an outer periphery of said vibrating plate; and a casing for supporting said speaker; wherein said magnetic circuit unit is arranged on a rear inner surface of said casing.

10. The speaker apparatus according to claim 9 wherein said vibrating plate is formed substantially in a planar configuration having a center opening whereat said voice coil is mounted.

11. The speaker apparatus according to claim 9 wherein said casing includes a front baffle plate and a rear baffle plate, arranged as a pair ahead and in back of said speaker, respectively, said rear baffle plate having a vibrating system supporting portion for supporting the set of resilient supporting members and a circuit supporting portion for supporting said magnetic circuit unit.

12. The speaker apparatus according to claim 11 wherein said vibrating plate is formed in a substantially planar configuration.

13. The speaker apparatus according to claim 11 wherein said rear baffle plate further includes a baffle member detachably mounted on said vibrating system supporting portion, said vibrating system supporting member forming a portion of the rear surface of said casing.

* * * * *